United States Patent [19]

Schiller

[11] Patent Number: 4,974,437

[45] Date of Patent: Dec. 4, 1990

[54] ROLLING MILL STAND

[75] Inventor: Günter Schiller, Lindlar, Fed. Rep. of Germany

[73] Assignee: SMS Schloemann-Siemag Aktiengesellschaft, Dusseldorf, Fed. Rep. of Germany

[21] Appl. No.: 375,969

[22] Filed: Jul. 6, 1989

[30] Foreign Application Priority Data

Jul. 6, 1988 [DE] Fed. Rep. of Germany ..... 3822821

[51] Int. Cl.[5] ..... B21B 28/00

[52] U.S. Cl. ..... 72/236; 72/201; 72/238; 72/250

[58] Field of Search ..... 72/238, 239, 250, 201, 72/236

[56] References Cited

U.S. PATENT DOCUMENTS

| | | | |
|---|---|---|---|
| 2,907,527 | 10/1959 | Cummings | 239/132 |
| 3,513,680 | 5/1970 | Modder | 72/250 |
| 3,864,954 | 2/1975 | Eibe et al. | 72/238 |
| 4,403,492 | 9/1983 | Hope | 72/201 |
| 4,491,005 | 1/1985 | Kimura et al. | 72/201 |
| 4,706,485 | 11/1987 | Gilvar et al. | 72/239 |

FOREIGN PATENT DOCUMENTS 0059417 1/1985 European Pat. Off. .

*Primary Examiner*—Lowell A. Larson
*Assistant Examiner*—T. C. Schoeffler
*Attorney, Agent, or Firm*—Herbert Dubno

[57] ABSTRACT

A strip mill has the strip deflectors, the strip guide tables, the spray devices for cooling the working rolls and the strip lifters all disposed in the region of the working rolls in a readily accessible structural unit which also forms the guide rails upon which the journal blocks for the working rolls are guided for withdrawal of the working rolls from the mill stand. The unit is connected with our integrated in the working roll bending blocks and parts of the unit are connected with the latter by an inclined groove and rib arrangement.

4 Claims, 4 Drawing Sheets

ROLLING MILL STAND

FIELD OF THE INVENTION

My present invention relates to a rolling mill stand and, more particularly, to a stand for producing rolled products, especially strip, which comprises in the stand, a plurality of rolls including a pair of superposed working rolls and, if desired, backup rolls or both backup rolls and intermediate rolls, strip deflectors at the inlet and outlet sides of the nip or gap between the working rolls, spray devices, rolled-strip lifters, withdrawal rails and rolled strip guide tables.

BACKGROUND OF THE INVENTION

A strip mill can be provided in a two-high, four-high or six-high arrangement in common constructions utilizing, respectively, a pair of working rolls alone, a pair of working rolls braced by a pair of backup rolls directly, or a pair of working rolls braced by a pair of backup rolls through the intermediary of intermediate rolls.

In general, such strip mills also include strip deflectors disposed both at the inlet and outlet sides of the rolling gap or nip between the working rolls, spray devices for directing cooling liquid sprays onto the working rolls, rolled-strip lifting devices or lifters, withdrawal rails and rolled strip guide tables.

Up to now, the deflectors, the spray devices, the rolled-strip lifters, the withdrawal rails and the roll strip guide tables, which are especially required for four-high reversing mills or six-high reversing mills or for transformation of a four-high reversing mill to a six-high reversing mill and with working roll diameters of 160/140 mm, have been largely provided externally of the mill frame or stand in a plurality of independent structures at both the inlet and outlet sides of the mill.

These elements located externally of the mill obviously require considerable space in the vicinity of the mill which may not always be available and also are not readily accessible so that they are difficult to maintain and service.

As a practical matter, therefore, such elements may not be provided even though they may be highly advantageous or desirable in many strip mills, especially where the larger mill stands and larger diameter working rolls are employed.

OBJECTS OF THE INVENTION

It is, therefore, the principal object of the present invention to provide an improved strip mill stand whereby these disadvantages are obviated, i.e. whereby prior art drawbacks are eliminated.

Another object of the present invention is to provide a strip mill stand which can have strip deflectors, spray devices, rolled-strip lifters, withdrawal rails and roll strip guide tables in a more convenient and accessible manner so that these units do not take up as much space as has been required in the past.

It is, therefore, also an object of the invention to provide a strip mill which has improved functioning and yet eases the spacial requirements for the mill assembly.

SUMMARY OF THE INVENTION

These objects and others which will become apparent hereinafter are attained, in accordance with the present invention, in a rolling mill stand and, especially a strip mill stand in which the rolled-strip lifters with the strip deflectors, spray devices, withdrawal rails and rolled strip guide table are joined in a single structural unit which is arranged within the mill stand in the direct vicinity of the rolling gap o nip of the working rolls.

Because a single unit is provided with the rolled-strip lifter, deflectors, spray devices, withdrawal rails and rolled strip guide tables and the entire unit is accommodated directly in the mill stand, special space need not be provided adjacent the mill stand along the rolling line for these elements.

The mill stand has a very compact space-saving construction and the entire mill line or rolling line likewise can be made more compact because these units are fully integrated within the rolling mill stand.

Surprisingly, the assembly is easily accessible and can be maintained and serviced with ease.

I have found, moreover, that the rolling mill construction according to the invention allows mounting and dismounting of the individual components of the mill stand and this unit in a very simple and easy manner.

It has been found, specifically, that the individual elements of the unit namely, the deflectors or the spray devices or the withdrawal rails or the rolled strip guide table, can be easily removed and replaced with the system of the invention while the overall structure ensures high reliability. Fluctuations of the roll line can be readily compensated using the apparatus of the invention in a simple manner and I have also found that the invention allows horizontal stabilization.

According to a further feature of the invention, the rolled-strip lifters with the strip deflectors and the spray devices are integrated into the working roll bending block.

The bending block for the working roll, in this case, has a recess into which the roll-withdrawal rails reach and upon which the mounting blocks for the working rolls are guided. This enables the insertion and removal of the working rolls rapidly and conveniently so that used working rolls can be replaced by unused working rolls or new working rolls can replace working rolls which are no longer effective, without interfering with the unit integrated into the bending block for the working roll.

According to another embodiment of the invention, the structural unit formed by the strip-lifting devices, the strip deflector and the spray nozzles are connected with the bending block for the working roll via grooves and ribs providing horizontal and vertical mobility with a minimum of play. This allows the unit to be adjusted, replaced and positioned, especially with respect to the rolling gap width and upon axial shifting of one working roll relative to the other.

Of course, the bending block itself may be formed in two parts which can be adjusted relative to one another by a hydraulic adjustment device as has been described, for example, in the European Patent 0 059 417.

According to yet another feature of the invention, the structural unit is connected with the bending block by a groove and rib construction, i.e. by groove and tongue formation which are inclined to the vertical. This construction has been found to be very advantageous for adjustment of the working roll bending block in the vertical direction and where the spacing of the strip deflectors from the roll surface can be held constant.

Advantageously, the rolled strip guide tables are formed by angular pieces of adjustable length mountable so as to run in the strip plane.

According to yet another feature of the invention, the strip-lifter devices with the strip deflectors and spray devices form a two-piece unit or structure which enables accommodation of the unit in roll stands with varying working roll diameters.

BRIEF DESCRIPTION OF THE DRAWING

The above objects, features and advantages of my invention will become more readily apparent from the following description, reference being made to the accompanying highly diagrammatic drawing in which.

SPECIFIC DESCRIPTION

Figure 1:
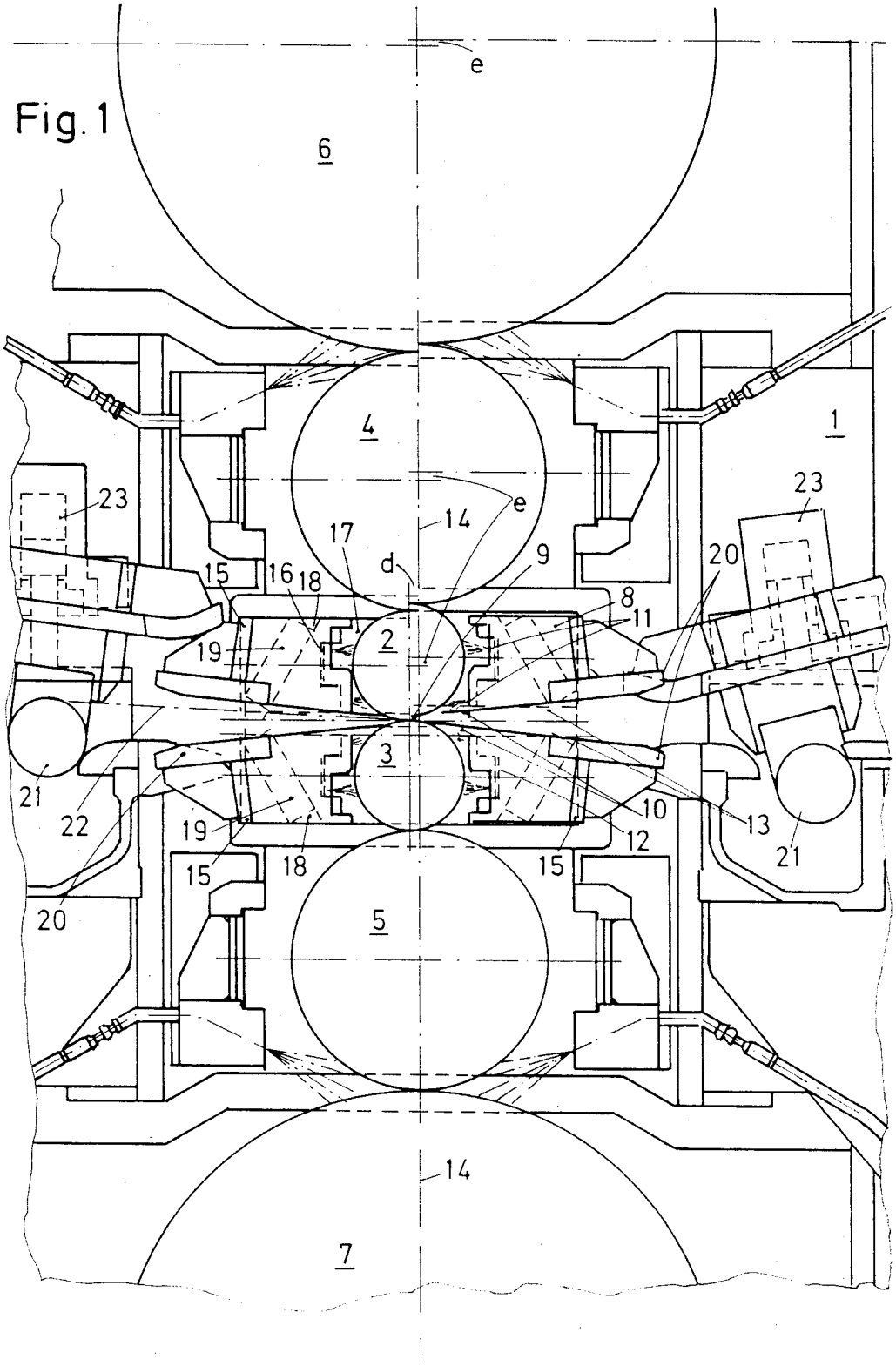
FIG. 1 is a side-elevational view, in a highly diagrammatic form, of a strip mill stand with two working rolls, two intermediate rolls and two backup rolls and formed with a unit built into the stand according to the present invention.

As will be apparent from FIG. 1, a six-high strip rolling mill, according to the invention, can comprise a rolling mill frame or stand 1 having a pair of working rolls 2, 3 disposed one above the other, respective intermediate rolls 4 and 5 braced against the working rolls, and respective backup rolls 6 and 7 braced respectively against the working rolls 4 and 5.

At both sides of the working rolls 2 and 3, i.e. on the inlet and outlet sides of the nip or rolling gap between them, the mill stand 1 is provided with roll-strip lifting devices 8, strip deflectors 10 converging toward the rolling gap 9, spray devices 11, withdrawal rails 12 and roll strip guide tables 13, disposed symmetrically on opposite sides of the gap for use of the mill as a reversing mill.

After passage of the strip between the working rolls 2 and 3 from the left, for example, of the vertical median plane 14 which also serves as a plane of symmetry for the latter elements, the strip can be passed in the opposite direction between the rolls 2 and 3 and the working gap can be closed further.

The working rolls 2 and 3, depending upon the rolling direction, will be offset from the vertical median plane 14 defined by the axes of the intermediate rolls 4 and 5 and the backup rolls 6 and 7 by a distance d in the horizontal direction either to the left or to the right.

The upper working roll 2, the intermediate roll 4 lying thereover and the backup roll 6 above the latter are shifted in the vertical direction by an amount e above the horizontal plane of the upper portion of the lower working roll corresponding to the working roll gap 9.

The right side of FIG. 1 shows the position of the apparatus at the time the strip is initially fed between the working rolls 2 and 3 while the left side of FIG. 1 shows the operating position, i.e. the actual rolling position of the parts.

The rolled-strip lifter devices 8 with the strip deflectors 10, the spray devices 11, the withdrawal rails 12 and the strip guide tables 13 are, according to the invention, disposed in a very compact and easily accessible unit which is located within the roll stand 1.

The rolled-strip lifters 8 with the deflectors 10 and the spray devices 11 are integrated in the roll-bending block 15 which, for this purpose, can be provided with recesses 16 in which the roll-withdrawal rails 2 engage. On these rails, the journal blocks or bodies 17 carrying the working rolls 2 and 3 engage at the ends of the working rolls.

The strip lifters 8 with the deflectors 10 and spray devices 11 form a rigid unit which is movable horizontally and vertically via groove and rib formations shown only in broken lines in the drawing and which are inclined to the vertical and the horizontal. The grooves are represented at 18 and the ribs which fit without lateral play but are guided in the grooves, are illustrated at 19. In the region of the working rolls, the grooves and ribs extend in the roll-bending blocks 15.

Because of the contrary inclinations of the horizontally and vertically movable groove and rib guide formations 18 and 19, the roll-bending block 15 of the upper working roll 2 is movable relative to the roll-bending block 15 of the lower working roll 3 so that the blocks together form a multifunction block supporting the rigid unit in a defined manner. The positions of the roll-bending blocks like in the cassette constructions known, are dependent upon the vertical and horizontal positions of the working rolls 2 and 3 as determined by the positions of the journaling member 17 in the rolling frame 1.

The provision of a multifunction block allows the insertion of the working roll pairs which have different diameters. Advantageously, they are used with relatively small diameter differences (140–160 mm).

However, when working rolls with greater roll diameter differences are used, by replacement of the horizontal wear bars, the journal blocks 17 which carry the working rolls 2 and 3 can be adjusted. The rolled strip guide tables 13 which extend in the rolling strip plane can be adjusted in their lengths by mountable angle pieces 20.

The invention thus provides a highly advantageous arrangement of the rolls 21 for guiding and stabilizing the rolled strip and of the hydraulic adjusters 23 or the rolls 21, the strip guide tables 13, etc., within the mill stand and immediately in the region of the rolling gap 9.

Before the rolling stand of the invention is placed in operation, the desired distance between the strip deflectors 10 and the effective rolling surfaces of the working rolls 2 and 3 at maximum roll diameters and closed rolling gap without strip therebetween, is set.

Figure 2:
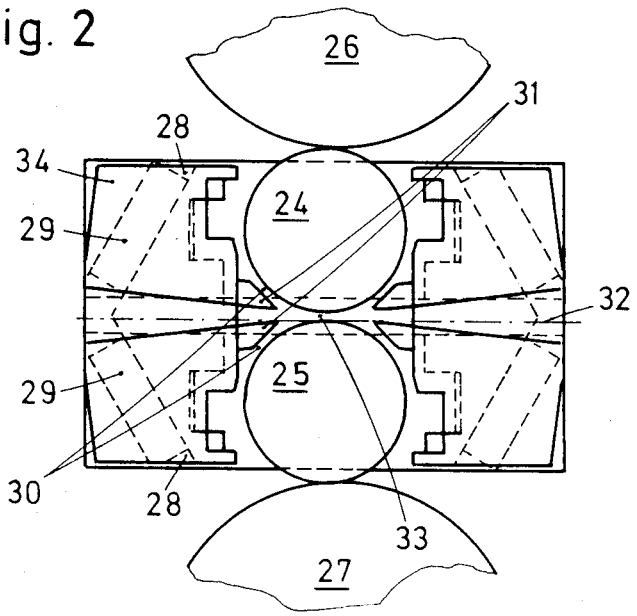
FIG. 2 is a view similar to FIG. 1 in the region of the working rolls for a portion of a mill having two working rolls and two backup rolls, showing the strip-lifting device in the feed-in position for the oncoming strip to be rolled, in accordance with the invention.

If the working roll diameters, because of wear become smaller during operation of the mill stand, during drive of the mill, the distance of the upper roll-bending block 15 carrying the upper working roll 2 from the lower roll-bending block 15 of working roll 3 will become correspondingly smaller. Because of the inclination of the grooves 18 and the ridges 19 sliding in these grooves, the multifunction block and thus the deflectors 10 will be moved in the direction of the rolling gap 9. As is especially apparent from the embodiment of FIG. 2 which shows two working rolls 24 and 25 and two intermediate or backup rolls 26 and 27, for a given inclination of the grooves 28/ridges 29, there remains an approximately constant spacing 30 between the surfaces of the working rolls 24, 25 and the strip deflectors 31. This means that the roll wear is completely and automatically compensated with respect to adjustment of the strip deflectors as the bending blocks of the two rolls move closer together as a function of such wear.

The strip 32 to be rolled contacts the lower working roll 25 and is optimally guided. The distance 30 between the surfaces of the working rolls 24 and 25 and the deflectors 31 is indeed effected during operation of the mill by the workpiece passing between the working rolls. However, this effect is not significant since, with thin strip, the distance difference is, for example, 0.2 mm and is negligible with thicker strip where the distance difference is substantially less than the strip thickness.

A thick strip thus can be passed through the mill without problems while, with a thin strip, the deflectors 32 ensure an optimal running of the strip 32 to be rolled.

So that the oncoming end of the strip to be rolled, upon passage into the open rolling gap 33 does not impact against the lower working roll 25 or against the upper working roll 24, the upper working roll 24 is moved upwardly to provide a vertical direction for a relative movement of the strip deflector 31 of the strip lifter 34 upwardly. Because of the inclined groove and rib arrangement 28, 29, these elements are shifted in the horizontal direction away from the working rolls 24 and 25.

Depending upon the height of the open rolling gap 33, therefore, the strip deflectors 31 can be provided immediately below or up to a point above the level of the bulges of the working rolls which may be of the dumbell- or bottle-shape.

Figure 3:
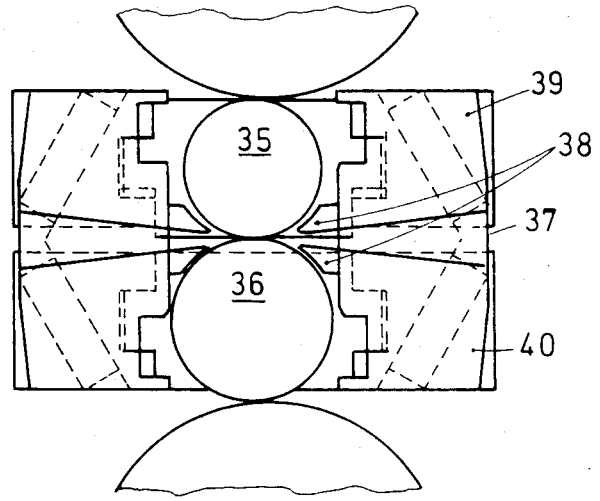
FIG. 3 is a view similar to FIG. 2 for a strip mill having two working rolls and two backup rolls, for a system in which the working rolls can be exchanged for working rolls of another diameter.

FIG. 3 shows an embodiment of the invention operating under similar principles and, in which the upper working roll 35 has a significantly smaller diameter than the lower working roll 36. This represents an extreme combination in which the upper strip deflector 38 must have a greater spacing from the working roll 35 than the lower strip deflector.

An optimal compensation is, however, provided for the deflector 38 located on the rolled strip lifting device 37 for this large difference in the dimensions of the working rolls 35, 36 by the groove and rib arrangement.

Wear-bar alteration and/or a subdivision of a strip lifting device 37 into two parts, namely, an upper part 39 and a lower part 40 are here highly advantageous.

Figure 4:
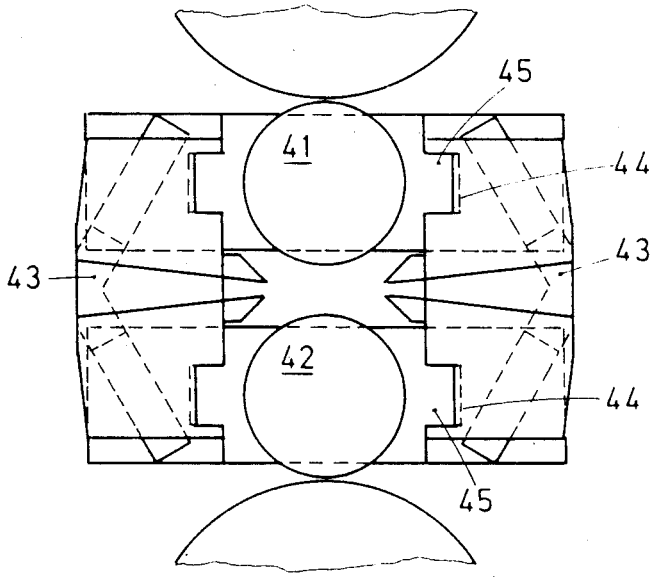
FIG. 4 is a view similar to FIG. 3 of a strip mill using two working rolls and two backup rolls, illustrating the roll change position according to the invention.

FIG. 4 shows an arrangement in which the working rolls 41 and 42 are in their roll-replacement position. In this position, the working rolls 41 and 42 assume their greatest vertical spacing from one another and, because of the inclined arrangement of the grooves and ridges, the multifunction block has the greatest spacing apart in the horizontal direction.

In this position, the multifunction block 43 on both sides of the working rolls 41 and 42, have rail portions 44 in the form of grooves through which the laterally projecting ribs 45, as rails, are guided.

Figure 5:
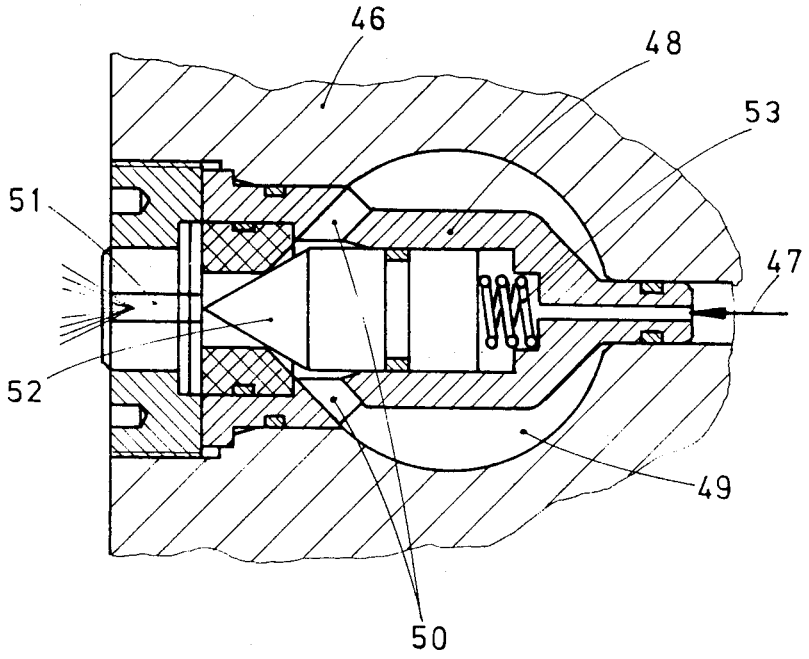
FIG. 5 is a detail cross section of a spray nozzle valve controlled by compressed air.

According to the invention, the multifunction block can also be provided with the spray devices represented generally at 11 in FIG. 1 and designed to direct a cooling spray upon the working gap or the working rolls. Each of the spray units can be, as shown in FIG. 5, a spring-loaded nozzle valve 46 controlled by compressed air. With this nozzle valve 46, preferably arranged in the direction of arrow 47 air is supplied axially to the nozzle body 48 under pressure to close the valve. When compressed air is not supplied, the liquid, e.g. water by passage under pressure into the annular space 49 can then flow through the openings 50 in the nozzle body to the nozzle outlet orifice 51 and is dispensed in finely divided form upon the respective roll of the mill.

The water pressure on the cone 52 effects a rearward movement thereof against the force of the spring 53 and thus provides a passage to the orifice 51. Of course, for sufficient roll cooling or lubrication, a plurality of such nozzle valves can be provided in rows along the multifunction block and trained upon the rolls.

The resulting highly stable multifunction bloc according to the invention, enables the deflectors to be mounted at a distance from the nozzle so that in resulting recesses, the controllable nozzles and also preset nozzles can be provided to spray directly into the rolling gap. The height of the multifunction block permits, advantageously, also a plurality of vertically spaced rows of the nozzles shown in FIG. to be provided.

The rolling mill of the invention also permits sensors, measuring units or the like to be mounted on the multifunction block and thus in the immediate region of the rolls and, if desired, directly in the strip deflectors or on other parts of the rolled-strip lifter devices.

Of course, the invention is not limited to the embodiment shown in the drawing. Thus without departing from the scope of the invention, the multifunction block can be varied in a variety of ways, especially in shape and with respect to the auxiliary means with which it may be supplied.

I claim:

1. A rolling mill for the rolling of strip, comprising:
a mill stand;
a pair of working rolls mounted on said stand;
respective journal blocks at each end of each of said rolls for rotatably supporting said rolls and being withdrawable with said rolls from said stand;
at least two additional rolls mounted in said stand and braced against said working rolls; and
at least one unit disposed in said stand adjacent said working rolls and formed with:
strip deflectors for guiding said strip into a working gap between said working rolls,
spray devices for directing cooling sprays at least against said working rolls,
withdrawal rails forming guides for said blocks enabling removal of said working rolls relative to said unit from said stand,
at least one strip-lifting device, and
at least one strip guide table, said lifter, at least one strip deflector connected to said lifter and said spray devices of said unit being horizontally and vertically movably connected with a working roll bending block for one of said working rolls by respective grooves and ribs slidably received in said grooves.

2. The rolling mill defined in claim 1 wherein said grooves and ribs are inclined to the vertical.

3. A rolling mill for the rolling of strip, comprising:
a mill stand;
a pair of working rolls mounted on said stand;

respective journal blocks at each end of each of said rolls for rotatably supporting said rolls and being withdrawable with said rolls from said stand, at least two additional rolls mounted in said stand and braced against said working rolls; and at least one unit disposed in said stand adjacent said working rolls and formed with:

strip deflectors for guiding said strip into a working gap between said working rolls, spray devices for directing cooling sprays at least against said working rolls, withdrawal rails forming guides for said blocks enabling removal of said working rolls relative to said unit from said stand, at least one strip-lifting device, and at least one strip guide table, said strip guide table being formed by angle pieces lying in a rolling strip plane and of variable length.

4. A rolling mill for the rolling of strip, comprising:

a mill stand;

a pair of working rolls mounted on said stand;

respective journal blocks at each end of each of said rolls for rotatably supporting said rolls and being withdrawable with said rolls from said stand, at least two additional rolls mounted in said stand and braced against said working rolls; and at least one unit disposed in said stand adjacent said working rolls and formed with:

strip deflectors for guiding said strip into a working gap between said working rolls, spray devices for directing cooling sprays at least against said working rolls, withdrawal rails forming guides for said blocks enabling removal of said working rolls relative to said unit from said stand, at least one strip-lifting device, and at least one strip guide table, said lifter, said deflector and said spray devices forming a two-part structural unit.

* * * * *